US011572611B2

(12) United States Patent
Bassi et al.

(10) Patent No.: US 11,572,611 B2
(45) Date of Patent: Feb. 7, 2023

(54) PROCESS FOR WARM FORMING AN AGE HARDENABLE ALUMINUM ALLOY IN T4 TEMPER

(71) Applicant: Novelis Inc., Atlanta, GA (US)

(72) Inventors: Corrado Bassi, Valais (CH); Etienne Combaz, Valais (CH); Aude Despois, Valais (CH); Pasquier Romain, Valais (CH); Maude Fumeaux, Valais (CH); Julie Richard, Valais (CH)

(73) Assignee: Novelis Inc., Atlanta, GA (US)

( * ) Notice: Subject to any disclaimer, the term of this patent is extended or adjusted under 35 U.S.C. 154(b) by 708 days.

(21) Appl. No.: 15/285,510

(22) Filed: Oct. 5, 2016

(65) Prior Publication Data

US 2017/0101706 A1 Apr. 13, 2017

Related U.S. Application Data

(60) Provisional application No. 62/239,014, filed on Oct. 8, 2015.

(51) Int. Cl.
*C22C 21/08* (2006.01)
*C22F 1/05* (2006.01)
(Continued)

(52) U.S. Cl.
CPC ..... *C22F 1/057* (2013.01); *B21D 22/02* (2013.01); *C22C 21/00* (2013.01); *C22C 21/02* (2013.01);
(Continued)

(58) Field of Classification Search
CPC . C22F 1/057; C22F 1/05; C22F 1/053; B21D 22/022
See application file for complete search history.

(56) References Cited

U.S. PATENT DOCUMENTS 5,911,844 A 6/1999 Benedyk
6,033,499 A 3/2000 Mitra
(Continued)

FOREIGN PATENT DOCUMENTS

EP 2581218 A1 4/2013
EP 2899287 3/2018
(Continued)

OTHER PUBLICATIONS

Rudnev, V and G.E. Totten, "Induction Heating and Heat Treatment", ASM Handbook, vol. 4C, p. 2-5. (Year: 2014).*
(Continued)

*Primary Examiner* — George Wyszomierski
*Assistant Examiner* — Janell C Morillo
(74) *Attorney, Agent, or Firm* — Kilpatrick Townsend & Stockton LLP

(57) ABSTRACT

Described are processes for shaping age hardenable aluminum alloys, such as 2XXX, 6XXX and 7XXX aluminum alloys in T4 temper, or articles made of such alloys, including aluminum alloy sheets. The processes involve heating the sheet or article before and/or concurrently with a forming step. In some examples, the sheet is heated to a specified temperature in the range of about 100-600° C. at a specified heating rate within the range of about 3-600° C./s, for example about 3-90° C./s. Such a combination of temperature and heating rate results in an advantageous combination of sheet properties.

9 Claims, 15 Drawing Sheets

(51) Int. Cl.

| | |
|---|---|
| ***C22F 1/057*** | (2006.01) |
| ***C22C 21/06*** | (2006.01) |
| ***C22C 21/00*** | (2006.01) |
| ***C22C 21/10*** | (2006.01) |
| ***C22F 1/04*** | (2006.01) |
| ***C22F 1/043*** | (2006.01) |
| ***C22F 1/047*** | (2006.01) |
| ***B21D 22/02*** | (2006.01) |
| ***C22C 21/02*** | (2006.01) |
| ***C22C 21/14*** | (2006.01) |
| ***C22C 21/16*** | (2006.01) |

(52) U.S. Cl.

CPC ..... *C22C 21/06* (2013.01); *C22C 21/08* (2013.01); *C22C 21/10* (2013.01); *C22C 21/14* (2013.01); *C22C 21/16* (2013.01); *C22F 1/04* (2013.01); *C22F 1/043* (2013.01); *C22F 1/047* (2013.01)

(56) References Cited

U.S. PATENT DOCUMENTS

| | | | | |
|---|---|---|---|---|
| 8,496,764 | B2 * | 7/2013 | Luckey | B21D 37/16 148/695 |
| 9,249,484 | B2 | 2/2016 | Kamat et al. | |
| 9,249,487 | B2 | 2/2016 | Yan et al. | |
| 10,384,252 | B2 | 8/2019 | Sachdev et al. | |
| 10,501,829 | B2 * | 12/2019 | Bohner | C22C 21/10 |
| 10,774,408 | B2 * | 9/2020 | Steinebach | C22F 1/04 |
| 11,072,844 | B2 | 7/2021 | Weykamp | |
| 2006/0130941 | A1 | 6/2006 | Litalien et al. | |
| 2012/0152416 | A1 | 6/2012 | Foster et al. | |
| 2012/0273098 | A1 | 11/2012 | Bohner et al. | |
| 2015/0020930 | A1 | 1/2015 | Kamat et al. | |
| 2015/0218677 | A1 * | 8/2015 | Aruga | C22C 21/10 420/532 |
| 2016/0122852 | A1 | 5/2016 | Kamat et al. | |
| 2016/0326619 | A1 | 11/2016 | Bassi et al. | |

FOREIGN PATENT DOCUMENTS

| | | | |
|---|---|---|---|
| JP | 2002544392 | | 12/2002 |
| JP | 2010196112 | | 9/2010 |
| JP | 2015039719 | | 3/2015 |
| WO | 9527091 | | 10/1995 |
| WO | 0070115 | | 11/2000 |
| WO | 2014135367 | A1 | 9/2014 |
| WO | 2017062403 | A1 | 4/2017 |

OTHER PUBLICATIONS

Japanese Application No. 2018-516852 , "Office Action", dated Oct. 8, 2019, 5 pages.
Korean Application No. 10-2018-7012271 , "Office Action", dated Oct. 14, 2019, 6 pages.
Canadian Application No. 3,000,025 , "Office Action", dated Nov. 12, 2019, 4 pages.
Australian Application No. 2016333810 , "First Examination Report", dated Jan. 25, 2019, 3 pages.
Japanese Application No. 2018-516852 , "Office Action", dated Jan. 8, 2019, 11 pages.
"ASTM E1004-09: Standard Test Method for Determining Electrical Conductivity Using the Electromagnetic (Eddy-Current) Method," Jun. 2009, ASTM International, 5 pages.
"ASTM E797/E797M-15: Standard Practice for Measuring Thickness by Manual Ultrasonic Pulse-Echo Contact Method," Dec. 2015, ASTM International, 7 pages.
"ASTM E8/EM8-16a: Standard Test Methods for Tension Testing of Metallic Materials," Sep. 2016, ASTM International, 30 pages.
"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.
International Patent Application No. PCT/US2016/055405, International Search Report and Written Opinion dated Jan. 18, 2017, 11 pages.
Canadian Application No. 3,000,025 , "Office Action", dated Mar. 21, 2019, 4 pages.
Korean Application No. 10-2018-7012271 , "Office Action", dated Apr. 1, 2019, 10 pages.
European Application No. 16784337.4 , "Office Action", dated Sep. 5, 2019, 6 pages.
International Application No. PCT/US2016/055405 , "International Preliminary Report on Patentability", dated Apr. 19, 2018, 8 pages.
Chinese Application No. 201680057704.X , "Office Action", dated Jun. 6, 2019, 20 pages.
Korean Application No. 10-2018-7012271 , "Office Action", dated Dec. 9, 2019, 5 pages.
"Aluminum Alloys", Penn State University, 1994.
"Marine Applications of Aluminum Alloys", Part One, May 2004.
Brazilian Application No. 1120180069361 , "Office Action", dated Mar. 10, 2020, 5 pages.
Indian Application No. 201817012802 , "First Examination Report", dated Apr. 24, 2020, 7 pages.
Canadian Application No. 3,000,025, Notice of Allowance, dated Jul. 3, 2020, 1 page.
Chinese Application No. 201680057704.X, Office Action, dated Jul. 23, 2020, 10 pages.
European Application No. 16784337.4, Notice of Decision to Grant, dated Jul. 23, 2020, 2 pages.
Mexican Application No. MX/A/2018/004158, Notice of Allowance, dated Jul. 30, 2020, 3 pages.
Chinese Application No. 201680057704.X , "Office Action", dated Apr. 9, 2020, 15 pages.
Brazilian Application No. 112018006936-1 , Office Action, dated Sep. 14, 2021, 3 pages.
Korean Application No. 10-2019-7038504 , Notice of Decision to Grant, dated Nov. 4, 2021, 4 pages.
Japanese Application No. 2018-516852, Notice of Decision to Grant, dated Jul. 20, 2021, 2 pages.
Korean Application No. 1020197038504, Office Action, dated Jul. 1, 2021, 4 pages.
Chinese Application No. 201680057704.X, Office Action dated Jul. 14, 2022, 21 pages (8 pages of Original Document and 13 pages of English Translation).
Han, et al. On-Site Operation Skills of Heat Treatment Workers National Defense Industry Press, Jul. 2008, 7 pages.
Luo, et al., Fundamentals of Engineering Materials and Machinery Manufacturing, Huazhong University of Science and Technology Press, Feb. 2012, 15 pages.
Ren, et al., Principles and Techniques of Metallographic Analysis, Shanghai Scientific and Technology Literature Press, Aug. 2013, 7 pages.

* cited by examiner

PROCESS FOR WARM FORMING AN AGE HARDENABLE ALUMINUM ALLOY IN T4 TEMPER

CROSS REFERENCE TO RELATED APPLICATION

The present application claims priority to and filing benefit of U.S. provisional patent application Ser. No. 62/239,014 filed on Oct. 8, 2015, which is incorporated herein by reference in its entirety.

FIELD OF THE INVENTION

The present invention relates to the field of aluminum alloys and related fields.

BACKGROUND

Aluminum alloys combine low density with structural strength and crash resistance, which makes them attractive for production of structural and body parts in the motor vehicle industry. However, aluminum alloys have lower formability compared to draw-quality steel. In some cases, relatively low formability of the aluminum alloys can lead to difficulties in obtaining good part designs and can create problems with failure due to fracture or wrinkling. Warm forming of aluminum alloy sheets is used in the motor vehicle industry to overcome these challenges since the aluminum alloys exhibit increased formability at elevated temperatures. Generally, warm forming is the process of deforming metal at an elevated temperature. Warm forming can maximize the metal's malleability but creates its own challenges. In some cases, heating may negatively affect mechanical properties of an aluminum alloy sheet. Heated aluminum alloy sheets may exhibit decreased strength during the stamping operations and the decreased strength characteristics may persist after cooling of the alloy sheet. Heating of the aluminum alloy sheets also can lead to increased thinning of the aluminum alloy parts during stamping operations. The aluminum alloy sheet or part may also experience an undesirable change in its metallurgical state.

Heat treatable, age hardenable aluminum alloys, such as 2XXX, 6XXX and 7XXX aluminum alloys, which are often used for the production of panels in motor vehicles, are typically provided to the manufacturer in the form of an aluminum sheet in a ductile T4 temper, in order to enable the manufacturer to produce desired automotive panels by stamping or pressing. To produce functional motor vehicle parts meeting the required strength specifications, parts produced from an aluminum alloy in T4 temper are typically heat treated post-production and subsequently age hardened, resulting in a part or sheet in T6 temper. Elevating the temperature of a heat treatable, age hardenable aluminum alloy during a warm forming step may prematurely convert the aluminum alloy part or sheet into a T6 temper, leading not only to decreased formability which could negatively affect subsequent forming steps, but also detrimentally affecting the manufacturer's ability to harden the parts during post production heat treatment and/or aging.

Accordingly, the manufacturers of aluminum alloy parts are in need of improved warm forming processes to produce the aluminum they use for making parts.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Disclosed are processes for shaping age hardenable aluminum alloys. The disclosed processes allow for warm forming of age hardenable aluminum alloys under conditions that increase the alloys' formability while maintaining the alloys' appropriate strength characteristics. The processes described herein can also limit the thinning of the alloy parts during stamping and preserve the metallurgical state and hardening ability of the alloy parts. These novel processes produce aluminum alloy parts that can surprisingly compete with steel in tensile elongation, while retaining T4 properties such as strength, elongation and aging capability, thereby providing the ability to replace steel parts in some applications and decrease the weight of vehicles. These aluminum alloy parts can accommodate recycled aluminum as input metal and increase fuel efficiency of vehicles.

In some examples, the process for shaping an article age-hardenable, heat treatable aluminum alloy includes heating the article to a temperature of about 100 to 600° C. at a heating rate of about 3 to about 90° C./second, and shaping the article. The heating the aluminum alloy may be before and/or concurrently with a forming step. In some cases, the heating of the article to a temperature can include heating to a temperature of about 150 to 450° C., about 250 to 450° C., and/or about 350 to 500° C.

In some cases, the article is a sheet. The article can be, in some cases, 2XXX, 6XXX and 7XXX aluminum alloys. In some cases, the article can be in T4 temper before the heating step. In some cases, the article is in T4 temper before and after the heating step.

In the disclosed warm forming processes, an article made from an aluminum alloy, such as an aluminum alloy sheet, is heated to a specified temperature in the range of about 100° C. to about 600° C. (for example, about 150 to 450° C., about 250 to 450° C., and/or about 350 to 500° C.) at a specified heating rate within the range of about 3° C./s to about 600° C./s, for example about 3° C./s to about 200° C./s or about 3° C./s to about 90° C./s. Such a combination of the temperature and the heating rate can result in an advantageous combination of the properties of the aluminum alloy sheet. In some cases, the heat treatment conducted at heating parameters described herein can enhance formability of the aluminum alloy, while maintaining its strength within acceptable limits and limiting thinning of the aluminum alloy parts during stamping. In some cases, elongation can serve as an indicator of formability; sheets and articles with higher elongation can have good formability. In some cases, the engineering strain of the heated article is 40-90%. In some cases, according to processes described herein, the elongation of the article can be increased by up to about 30% in comparison to the article prior to heating. In some cases, the heated article can be characterized be a thinning value, for example, the thinning of the article after shaping can be less than about 22%. In some cases, the strength characteristics and the aging capability of the heated aluminum alloy sheet or article can be preserved after the heat treatment.

In some cases, the process for shaping an article can optionally comprise a step of cooling the shaped article. In some cases, the process for shaping an article can optionally include an additional shaping step after the cooling step.

In some examples, the heat treatment is accomplished by induction heating, although other heating processes can be employed, as discussed further in more detail. The disclosed processes can be incorporated in the production lines and processes employed in the transportation and motor vehicle industries, for example, the transportation industry for manufacturing of aluminum parts, such as automotive body panels, or parts of trains, airplanes, ships, boats and spacecraft. The disclosed processes are not limited to the automotive industry or, more generally, the motor vehicle industry, and can be advantageously employed in other areas that involve fabrication of aluminum articles.

Described herein also are shaped aluminum alloy articles produced according to the disclosed processes. In some cases, the shaped aluminum alloy is a motor vehicle panel. In some cases, the shaped aluminum alloy article can have an ultimate tensile strength of at least about 150 MPa. In some cases, the shaped aluminum alloy article can have an ultimate tensile strength of about 10 to 150 MPa.

Other objects and advantages of the invention will be apparent from the following detailed description.

DETAILED DESCRIPTION

Figure 1:
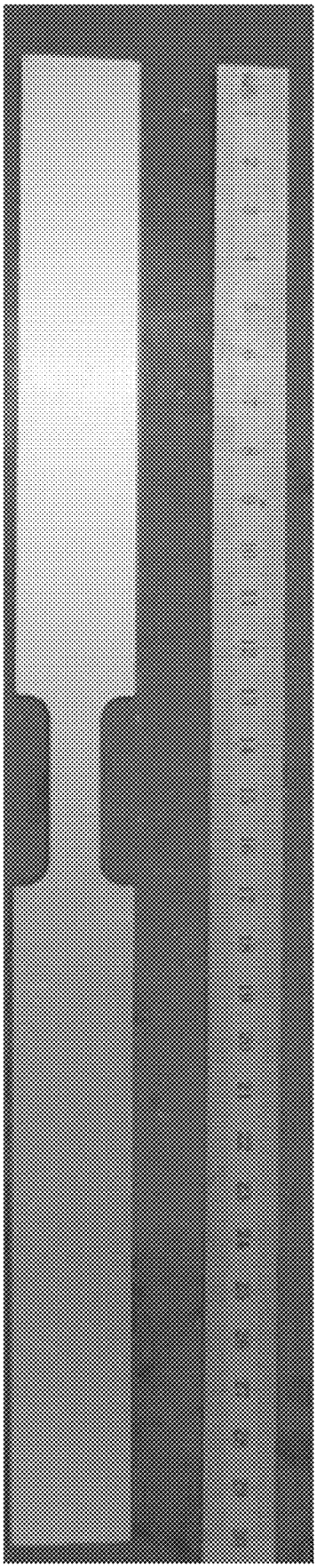
FIG. 1 is a photograph of a sample aluminum alloy specimen used for tensile testing.

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

In the following examples, the aluminum alloys are described in terms of their elemental composition in weight percent (wt. %). In each alloy, the remainder is aluminum, with a maximum wt. % of 0.15% for the sum of all impurities.

Unless other specified herein, room temperature refers to a temperature between about 20° C. to about 25° C., including 20° C., 21° C., 22° C., 23° C., 24° C., or 25° C.

Unless otherwise specified, heat treatment generally refers to heating an alloy sheet or article to a temperature sufficient to warm form the alloy sheet or article. The heat treatment for warm forming can be conducted prior to and/or concurrently with the forming step, so that the forming is performed on the heated aluminum alloy sheet or article.

Aluminum Alloys and Articles

The disclosed processes can be carried out with any aluminum alloy, for example, an aluminum alloy containing Al, Mg, Si and, optionally, Cu, and capable of exhibiting an age hardening response. Aluminum alloys that can be subjected to the disclosed processes include heat treatable, age hardenable aluminum alloys (e.g., alloys that may be strengthened by thermal treatment and/or aging), such as 2XXX, 6XXX, and 7XXX series alloys. Non-limiting examples include AA6010, AA6013, AA6056, AA6111, AA6016, AA6014, AA6008, AA6005, AA6005A, AA6120, AA6170, AA7075, AA7085, AA7019, AA7022, AA7020, AA2013, AA2014, AA2008, AA2014, and AA2017, and AA2024.

Exemplary aluminum alloys may comprise the following constituents besides aluminum (all expressed in weight percent (wt. %)): Si: 0.4-1.5 wt. %, Mg: 0.3-1.5 wt. %, Cu: 0-1.5 wt. %, Mn: 0-0.40 wt. %, and Cr: 0-0.30 wt. %. In another example, the aluminum alloys may comprise the following constituents besides aluminum: Si: 0.5-1.4 wt. %, Mg: 0.4-1.4 wt. %, Cu: 0-1.4 wt. %, Mn: 0-0.35 wt. %, and Cr: 0-0.25 wt. %. In yet another example, the aluminum alloys may comprise the following constituents besides aluminum: Si: 0.6-1.3 wt. %, Mg: 0.5-1.3 wt. %, Cu: 0-1.3 wt. %, Mn: 0-0.30 wt. %, and Cr: 0-0.2 wt. %. In still another example, the aluminum alloys may comprise the following constituents besides aluminum: Si: 0.7-1.2 wt. %, Mg: 0.6-1.2 wt. %, Cu: 0-1.2 wt. %, Mn: 0-0.25 wt. %, and Cr: 0-0.15 wt. %.

The composition of an aluminum alloy may affect its response to heat treatment. For example, the strength during or after heat treatment may be affected by an amount of Mg or Cu—Si—Mg precipitates present in the alloy. Suitable aluminum alloys for use in the methods disclosed herein are provided in a T4 temper. The designation "T4" temper means that an aluminum alloy was solution heat treated and then naturally aged to a substantially stable condition (but was not artificially aged). Other suitable aluminum alloys are provided in an F temper, which means as fabricated. In some examples of the processes described herein, the aluminum alloy remains in the same state (such as in the T4 temper) after the warm forming step as before the warm forming step. In comparison, other warm forming processes may convert an aluminum alloy from T4 to T6 temper; the "T6" designation means the aluminum alloy was solution heat treated and subsequently artificially aged.

The aluminum alloy articles that can be subjected to the disclosed warm forming processes can be called a "starting article" or a "starting material" and include sheets, plates, tubes, pipes, profiles, and others as long as the heating rate is achieved. The terms "article," "material" and "part" can be used interchangeably herein. An aluminum alloy sheet that may be used as a starting material in the disclosed processes can be produced in a sheet form at a desired thickness (gauge), for example, in a thickness suitable for production of motor vehicle parts. An aluminum alloy sheet can be a rolled aluminum sheet produced from aluminum alloy ingots, billets, slabs, strips or the like.

Different methods may be employed to make the aluminum sheet or plate provided it is in the T4 state before the warm forming process. For example, the aluminum alloy sheet can be produced by a process comprising: direct chill casting the aluminum alloy into an ingot; hot rolling the ingot to make a sheet; and cold rolling the sheet to a final gauge. Continuous casting or slab casting may be employed instead of direct chill casting to make the starting material which is processed into a sheet. The aluminum alloy sheet production process can also include annealing or solution heat treatment, meaning a process of heating the alloy to a suitable temperature and holding it at that temperature long enough to cause one or more constituents to enter into a solid solution, and then cooling it rapidly enough to hold these constituents in solution. In some cases, the aluminum alloy sheet and/or plate can have a thickness of about 0.4 mm to about 10 mm, or from about 0.4 mm to about 5 mm.

The aluminum alloy sheet can be unrolled or flattened prior to performance of the disclosed processes. The aluminum alloy articles include two- and three-dimensionally shaped aluminum alloy articles. One example of the alloy article is unrolled or flattened sheet, another example is a flat article cut from a sheet, without further shaping. Another example is a non-planar aluminum alloy article produced by a process that involves one or more three-dimensional shaping steps, such as bending, stamping, pressing, press-forming or drawing. Such a non-planar aluminum alloy article can be referred to as "stamped," "pressed," "press-formed," "drawn," "three dimensionally shaped" or other similar terms. Prior to being shaped according to the disclosed warm forming processes, an aluminum alloy article can be pre-formed by another "warm forming" or a "cold forming" process, step or a combination of steps. The aluminum alloy articles produced using the disclosed processes, which can be referred to as shaped articles or products, are included within the scope of the invention.

The disclosed processes can be advantageously employed in the transportation and motor vehicle industries, including but not limited to, automotive manufacturing, truck manufacturing, manufacturing of ships and boats, manufacturing of trains, airplane and spacecraft manufacturing. Some non-limiting examples of motor vehicle parts include floor panels, rear walls, rockers, motor hoods, fenders, roofs, door panels, B-pillars, longerons, body sides, rockers or crash members. The term "motor vehicle" and the related terms as used herein are not limited to automobiles and include various vehicle classes, such as, automobiles, cars, buses, motorcycles, marine vehicles, off highway vehicles, light trucks, trucks or lorries. However, aluminum alloy articles are not limited to motor vehicle parts; other types of aluminum articles manufactured according to the processes described in this application are envisioned. For example, the disclosed processes can be advantageously employed in manufacturing of various parts of mechanical and other devices or machinery, including weapons, tools, bodies of electronic devices, etc.

Aluminum alloy articles can be comprised of or assembled from multiple parts. For example, motor vehicle parts may be assembled from more than one part (such as an automobile hood having an inner and an outer panel, or an automobile door having an inner and an outer panel, or an at least partially assembled motor vehicle body having multiple panels). Furthermore, such aluminum alloy articles comprised of or assembled from multiple parts may be suitable for the disclosed warm forming processes after they are assembled or partially assembled. Also, in some cases, aluminum alloy articles may contain non-aluminum parts or sections, such as parts or sections containing or fabricated from other metals or metal alloys (for example, steel or titanium alloys). In some examples, aluminum alloy articles may have a core and clad structure, with a clad layer on one or both sides of the core layer.

Heating

The disclosed processes of shaping aluminum sheets or articles made from such sheets involves heating the alloys, sheets, or the articles. In some examples, heating the alloys, sheets, or the articles is performed to a specified temperature or to a temperature within a specified range and at a specified heating rate or at a heating rate within a specified range. Temperatures, heating rates or their ranges, or combinations of those, can be referred to as "heating parameters." In the processes described herein, the sheet or the article is heated to a temperature of about 450-600° C., 400-600° C., 350-600° C., 300-600° C., 250-600° C., 200-600° C., 150-600° C., 100-600° C., 450-550° C., 400-550° C., 350-550° C., 300-550° C., 250-550° C., 200-550° C., 150-550° C., 100-550° C., 450-500° C., 400-500° C., 350-500° C., 300-500° C., 250-500° C., 200-500° C., 150-500° C., 100-500° C., 400-450° C., 350-450° C., 300-450° C., 250-450° C., 200-450° C., 150-450° C., 100-450° C., 350-400° C., 300-400° C., 250-400° C., 200-400° C., 150-400° C., 100-400° C., 300-350° C., 250-350° C., 200-350° C., 150-350° C., 100-350° C., 250-300° C., 200-300° C., 150-300° C. or 100-300° C., for example, up to about 100° C., 125° C., 150° C., 175° C., 200° C., 225° C., 250° C., 275° C., 300° C., 325° C., 350° C., 375° C., 400° C., 425° C., 450° C., 475° C., 500° C., 525° C., 550° C., 575° C. or 600° C.

A heating rate of 3-90° C./s, 10-90° C./s, 20-90° C./s, 30-90° C./s, 40-90° C./s, 50-90° C./s, 60-90° C./s, 70-90° C./s or 80-90° C./s may be used. In some examples, a heating rate of about 90° C./s is employed. In other examples, a heating rate of about 3° C./s to about 100° C./s, 110° C./s, 120° C./s, 150° C./s, 160° C./s, 170° C./s, 180° C./s, 190° C./s, or 200° C./s may be employed. In another example, a heating rate of about 90° C./s to about 150° C./s may be employed. In other examples, a heating rate of about 200° C./s to about 600° C./s may be employed. For example, a heating rate of about 200° C./s to about 250° C./s, 300° C./s, 350° C./s, 400° C./s, 450° C./s, 500° C./s, 550° C./s, or 600° C./s may be employed. One of ordinary skill in the art may adjust the heating rate with available equipment depending on the desired properties of the sheet or article.

Various heating parameters can be employed in the heating processes. In one example, a heating rate of about 90° C./s to a temperature of 100-600° C. is employed. In another example, a heating rate of about 90° C./s to a temperature of 100-450° C. is employed. In yet another example, a heating rate of about 90° C./s to a temperature of 250-350° C. is employed. In one more example, a heating rate of about 90° C./s to a temperature of 250-450° C. is employed. The heating parameters are selected based on a variety of factors, such as a desired combination of the properties of the aluminum alloy or aluminum alloy article.

The above temperatures and temperature ranges are used to denote "heated to" temperature. In the disclosed processes, the heating process is applied to a sheet or article until the "heated to" temperature is achieved. In other words, the "heated to" temperature is the temperature to which the sheet or article is heated prior to the shaping step. The "heated to" temperature may be maintained during the shaping step by an appropriate heating process, or the heating process may be stopped before the shaping step, in which case the temperature of the sheet or article during the shaping step may be lower than the specified "heated to" temperature. The temperature of the sheet or article may or may not be monitored by appropriate procedures and instruments. For example, if the temperature is not monitored, the "heated to" temperature may be a calculated temperature and/or experimentally deduced temperature.

The heating rate can be achieved by choosing an appropriate heat treatment, heating process or system to heat the aluminum alloy sheet. Generally, the heating process or system employed should deliver sufficient energy to achieve the above-specified heating rates. For example, the heating can be accomplished by induction heating. Some non-limiting examples of heating processes that can be employed are contact heating, induction heating, resistance heating, infrared radiation heating, heating by gas burner, and direct resistive heating. Generally, design and optimization of the heating system and protocol may be performed to manage heat flow and/or to achieve the desired characteristics of the sheet or article.

Properties

Heating of the sheet or article in the course as disclosed herein results in an advantageous combination of properties. For example, an advantageous combination of formability and strength properties of the sheet or article is achieved. In some other cases, the sheet can also exhibit advantageously low thinning during shaping. In addition, the sheet or article remains in the same metallurgical state before and after heating and preserves certain properties and behaviors, once cooled, in comparison to the properties possessed by the sheet or article prior to heating.

The disclosed processes enhance the formability of the sheet or article. Formability of a sheet or article is a measure of the amount of deformation it can withstand prior to fracture or excessive thinning. Elongation can serve as an indicator of formability; sheets and articles with higher elongation have good formability. Generally, elongation refers to the extent to which a material can be bent, stretched or compressed before it ruptures. Elongation of a sheet or article and other properties influencing formability, outcome of the shaping process and the quality of the resulting products can be determined by tensile testing.

Tensile testing of samples is conducted according to standard procedures known in the area of material science described in relevant publications, such as those provided by American Society for Testing and Materials (ASTM). ASTM E8/EM8 (DOI: 10.1520/E0008 E0008M-15A) entitled "Standard Test Methods for Tension Testing of Metallic Materials" specifies tensile testing procedures for metallic materials. Briefly, tensile testing is conducted in a standard tensile testing machine known to one of ordinary skill in the art. A sample is typically a flat specimen of standard shape having two shoulders (which can be readily gripped by the machine) and a gauge area of a smaller cross section. During testing, the specimen is placed in the testing machine and extended uniaxially until it fractures, while elongation of the gauge section of the alloy specimen is recorded against the applied force. Elongation is the amount of permanent stretch of a specimen and is measured as the increase in the gauge length of a test specimen. The gauge length of the testing specimen is specified because it influences the elongation value. Some properties measured during tensile testing and used to characterize the aluminum alloy are engineering stress, engineering strain and elongation at fracture. The elongation measurement can be used to calculate "engineering strain," or the ratio of the change in length of the gauge to the original length. Engineering strain can be reported in percent (%). Elongation at fracture, which can also be reported as total elongation, is the amount of engineering strain at fracture of the specimen. Engineering stress is calculated by dividing the load applied to the specimen by the original cross-sectional area of the test specimen. Engineering strain and engineering stress data points can be graphed into a stress-strain curve.

The heating step employed in the disclosed warm forming processes improves elongation of the sheet or article, in comparison to the same sheet or article at room temperature. For example, the heating step may improve elongation of the sheet or article by up to about 30%, by up to about 20%, by up to about 15%, by at least 15%, by at least 5%, by about 5-15%, by about 5-20%, or by about 5-30%, in comparison to the condition prior to heating. In some cases, the elongation of is improved by about 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29% or 30%. In some instances, heating of the sheet or article results in elongation (measured as engineering strain) of at least about 40%, at least about 45%, at least about 50%, at least about 55%, at least about 60%, at least about 70%, at least about 75%, at least about 80%, at least about 85%, or of about 35-85%, 35-80%, 35-75%, 35-70%, 35-65%, 35-60%, 40-85%, 40-80%, 40-75%, 40-70%, 40-65%, 40-60%, 45-85%, 45-80%, 45-75%, 45-70%, 45-65%, 45-60%, 50-85%, 50-80%, 50-75%, 50-70%, 50-65% or 50-60%. In some examples, elongation values of the aluminum sheet or article comparable to those of steel taken at room temperature (about 53%) are achieved.

The heating step employed in the disclosed processes improves elongation of the heated sheet or article while preserving the strength properties (for example, tensile strength, measured as engineering stress) within a range suitable for industrial forming processes. For example, the heated aluminum sheet or article may have an ultimate tensile strength (measured as engineering strain during tensile testing) of at least about 10 MPa, at least about 20 MPa, at least about 30 MPa, at least about 40 MPa, at least about 50 MPa, at least about 60 MPa, at least about 70 MPa, at least about 80 MPa, at least about 90 MPa, at least about 100 MPa, at least about 110 MPa, at least about 120 MPa, at least about 130 MPa, at least about 140 MPa, at least about 150 MPa, about 10-150 MPa, about 10-140 MPa, about 10-130 MPa, about 10-120 MPa, about 10-110 MPa, about 10-100 MPa, about 10-90 MPa, about 10-80 MPa, about 10-70 MPa, about 10-60 MPa, about 10-50 MPa, about 20-150 MPa, about 20-140 MPa, about 20-130 MPa, about 20-120 MPa, about 20-110 MPa, about 20-100 MPa, about 20-90 MPa, about 20-80 MPa, about 20-70 MPa, about 20-60 MPa, about 20-50 MPa, about 30-150 MPa, about 30-140 MPa, about 30-130 MPa, about 30-120 MPa, about 30-110 MPa, about 30-100 MPa, about 30-90 MPa, about 30-80 MPa, about 30-70 MPa, about 30-60 MPa, about 30-50 MPa, about 40-150 MPa, about 40-140 MPa, about 40-130 MPa, about 40-120 MPa, about 40-110 MPa, about 40-100 MPa, about 40-90 MPa, about 40-80 MPa, about 40-70 MPa, about 30-60 MPa or about 30-50 MPa.

Heat treatment conditions may be selected to improve formability while limiting the thinning of the sheet or article. One of the challenges of a warm forming process is that high temperature typically increases thinning of the aluminum part, sometimes dramatically, during the forming step due to strain localization. To illustrate, a thinning value of higher than 15% (measured by standard testing protocols) may not be acceptable in a manufacturing process, yet a warm forming step may create thinning values of 40-50%. The heating parameters used in the disclosed processes lead to observed thinning values of less than or equal to about 40%, 35%, 30%, 25%, 20%, 15% or 10%, for example, 5-10%, 5-15%, 5-20%, 5-25%, 5-30%, 5-35%, 5-40%, 10-15%, 10-20%, 10-25%, 10-30%, 10-35%, 10-40%, 15-20%, 15-25%, 15-30%, 15-35%, 15-40%, 20-25%, 20-30%, 20-35% or 20-40%. The thinning values are observed in combination with a specified pre-strain of a testing specimen during the testing. For example, about 15% thinning at about 55% pre-strain, or about 22% thinning at about 65% pre-strain may be observed. To characterize the thinning characteristics, the aluminum alloy samples are tested according to standard procedures known in the area of material science described in relevant materials, such as those provided by American Society for Testing and Materials (ASTM). ASTM E797, entitled "Standard Practice for Measuring Thickness by Manual Ultrasonic Pulse-Echo Contact Method," specifies the relevant testing procedures for metallic materials. These procedures are illustrated in the Example 4 entitled "Thinning testing" below.

The heat treatment conditions that can be used in the disclosed warm forming processes are selected so that that the metallurgical state and the aging behavior and properties of the aluminum sheet or article are preserved. Competition of precipitation and dissolution processes in an aluminum alloy during heating often leads to transition of the alloy in T4 temper into a different temper, such as T6, overaging with the attendant loss of strength, and loss of age hardening properties, because the alloy's hardening constituents precipitated during the heating step. In this situation, the process steps subsequent to heating and aimed at hardening will not have the desired effect. For example, it is known for the above effects to occur when relatively low heating rates, such as 0.1° C./s, are employed during warm forming steps. The disclosed processes avoid these disadvantages by employing higher heating rates.

The heating step employed prior to or during the disclosed warm forming processes preserves the strength properties (for example, tensile strength, measured as engineering stress) of the sheet or article after cooling, optionally followed by age hardening and/or heat treatment, within a range suitable for manufacturing practices. For example, in some examples, the sheet or article has ultimate tensile strength, measured as engineering strain during tensile testing, after cooling by water quenching, followed by one week of age hardening at room temperature and, optionally, heat treatment at 180° C. for 10 hours, of at least about 10 MPa, at least about 20 MPa, at least about 30 MPa, at least about 40 MPa, at least about 50 MPa, at least about 60 MPa, at least about 70 MPa, at least about 80 MPa, at least about 90 MPa, at least about 100 MPa, at least about 110 MPa, at least about 120 MPa, at least about 130 MPa, at least about 140 MPa, about 10-150 MPa, about 10-140 MPa, about 10-130 MPa, about 10-120 MPa, about 10-110 MPa, about 10-100 MPa, about 10-90 MPa, about 10-80 MPa, about 10-70 MPa, about 10-60 MPa, about 10-50 MPa, about 20-150 MPa, about 20-140 MPa, about 20-130 MPa, about 20-120 MPa, about 20-110 MPa, about 20-100 MPa, about 20-90 MPa, about 20-80 MPa, about 20-70 MPa, about 20-60 MPa, about 20-50 MPa, about 30-150 MPa, about 30-140 MPa, about 30-130 MPa, about 30-120 MPa, about 30-110 MPa, about 30-100 MPa, about 30-90 MPa, about 30-80 MPa, about 30-70 MPa, about 30-60 MPa, about 30-50 MPa, about 40-150 MPa, about 40-140 MPa, about 40-130 MPa, about 40-120 MPa, about 40-110 MPa, about 40-100 MPa, about 40-90 MPa, about 40-80 MPa, about 40-70 MPa, about 30-60 MPa or about 30-50 MPa.

The heating step employed in the disclosed warm forming processes preserves the metallurgical state of the alloy after cooling, optionally followed by age hardening and/or heat treatment, within a range suitable for manufacturing practices. The metallurgical state can be characterized by electrical conductivity, measured according to the standard protocols. ASTM E1004, entitled "Standard Test Method for Determining Electrical Conductivity Using the Electromagnetic (Eddy-Current) Method," specifies the relevant testing procedures for metallic materials. For example, in some examples, a 6XXX aluminum alloy sheet has an electrical conductivity or 26-27.5 millisiemens per meter (MS/m), after cooling by water quenching, followed by one week of age hardening at room temperature and, optionally, heat treatment at 180° C. for 10 hours.

The articles shaped according to the disclosed warm forming processes can combine properties discussed above in various ways. For example, a sheet or an article may have one or more of: elongation of 57% at 350° C., ultimate tensile strength of 51 MPa at 350° C., ultimate tensile strength of 197 MPa after being subjected to heat treatment at 350° C., followed by water quenching and aging for one week at room temperature, and conductivity of 27 MS/m after being subjected to heat treatment at 350° C., followed by water quenching and aging for one week at room temperature. Other values or ranges of values, such as those listed earlier in this section, may be displayed by the sheet or article.

Shaping

The disclosed processes may include at least one shaping step during or after the heating step. The term "shaping," as used herein, may include cutting, stamping, pressing, press-forming, drawing or other processes that can create two- or three-dimensional shapes as known to one of ordinary skill in the art. An article made of an age-hardenable, heat treatable aluminum alloy is heated, as discussed earlier in this document, and the heated article is shaped. The above shaping step can be included within to a warm forming process. Warm forming can be performed by stamping or pressing. In the stamping or pressing process step, described generally, an article is shaped by pressing it between two dies of complementary shape. Warm forming can be conducted under isothermal or nonisothermal conditions. Under isothermal conditions, the aluminum alloy blank and all the tooling components, such as the dies, are heating to the same temperature. Under non-isothermal conditions, the tooling components may have different temperatures than then blank.

Besides the above warm-forming step, the disclosed processes may include additional shaping steps. For example, prior to warm forming, an aluminum alloy article can be shaped by a combination of one or more of warm forming or cold forming processes or steps. For example, a sheet may be sectioned prior to being subjected to warm forming, for example, by cutting into precursor articles or forms termed "blanks," such as "stamping blanks," meaning precursors for stamping. Accordingly, a step of cutting an aluminum sheet into "stamping blanks" to be further shaped in a stamping press may be utilized. A sheet or blank may also be shaped by stamping prior to warm forming.

Industrial Processes

The disclosed processes may be incorporated into the existing processes and lines for production of aluminum alloy articles, such as stamped aluminum articles (for example, stamped automotive panels), thereby improving the processes and the resulting articles in a streamlined and economical manner. The apparatuses and systems for performing the processes and producing the articles described in this document are included within the scope of the present invention.

An exemplary process for producing a stamped aluminum alloy article, such as a motor vehicle panel, includes several (two or more, such as two, three, four, five, six or more) steps of stamping the article on a sequence of stamping presses ("press line"). The process includes one or more heat treatment steps conducted at different process points prior to or during one or more of the stamping steps. A stamping blank is provided before the first stamping step. A heating step may be conducted on a stamping blank before the first stamping step (that is, at the entry of the press line). A heating step may also be included after one or more of the first or intermediate pressing steps. For example, if the pressing line includes five stamping presses and corresponding steps, such a heating step may be included before one or more of the first, second, third, fourth and fifth intermediate stamping steps.

Heating steps may be included in a production process in various combinations, and various considerations may be taken into account when deciding on a specific combination and placement of the heating steps in a production process. For example, a heating step may occur prior to one or more stamping steps in which higher formability is desirable. The process may include one or more warm forming steps and one or more cold forming steps. For example, in a two-step process, an aluminum sheet may be shaped in a warm forming step, followed by a cold forming step. Alternatively, a cold forming step may precede a warm forming step.

Also disclosed are systems for conducting the processes for producing or fabricating aluminum alloy articles that incorporate equipment for practicing the disclosed processes. One exemplary system is a press line for producing stamped articles, such as panels, which incorporates warm forming stations or systems at various points in the line.

The disclosed processes can include additional steps employed in production of aluminum articles, such as cutting, hemming, joining, other heat treatment steps conducted concurrently or post-forming, cooling, age hardening, or steps of coating or painting an article with suitable paint or coating. The processes can include a paint baking step, which can be referred to as "paint baking," "paint bake," "paint bake cycle" or other related terms. Some of the steps employed in the processes of producing or manufacturing an aluminum article, such as post-forming heat treatment steps and a paint bake cycle, may affect the aging of an aluminum alloy from which the article is manufactured and thus affect its mechanical properties, such as strength. The resulting article may be in a temper other than T4 temper, for example, in a T6 temper.

An exemplary process of producing or manufacturing an aluminum article may include the steps of heating an aluminum alloy blank to a temperature of 100-600° C. at a heating rate of 3-90° C./s, quickly transferring the blank into a stamping tool, shaping the blank by stamping in the stamping tool, after stamping one or more of steps of cutting, hemming and joining, followed by a heat treatment step. Another exemplary process of producing or manufacturing an aluminum article may include the steps of heating an aluminum alloy blank to a temperature of 100-500° C. at a heating rate of 3-90° C./s, quickly transferring the blank into a stamping tool, shaping the blank by stamping in the stamping tool, after stamping one or more of steps of cutting, hemming and joining, followed by a heat treatment step.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

Example 1

Elevated Temperature Tensile Testing

Figure 2:
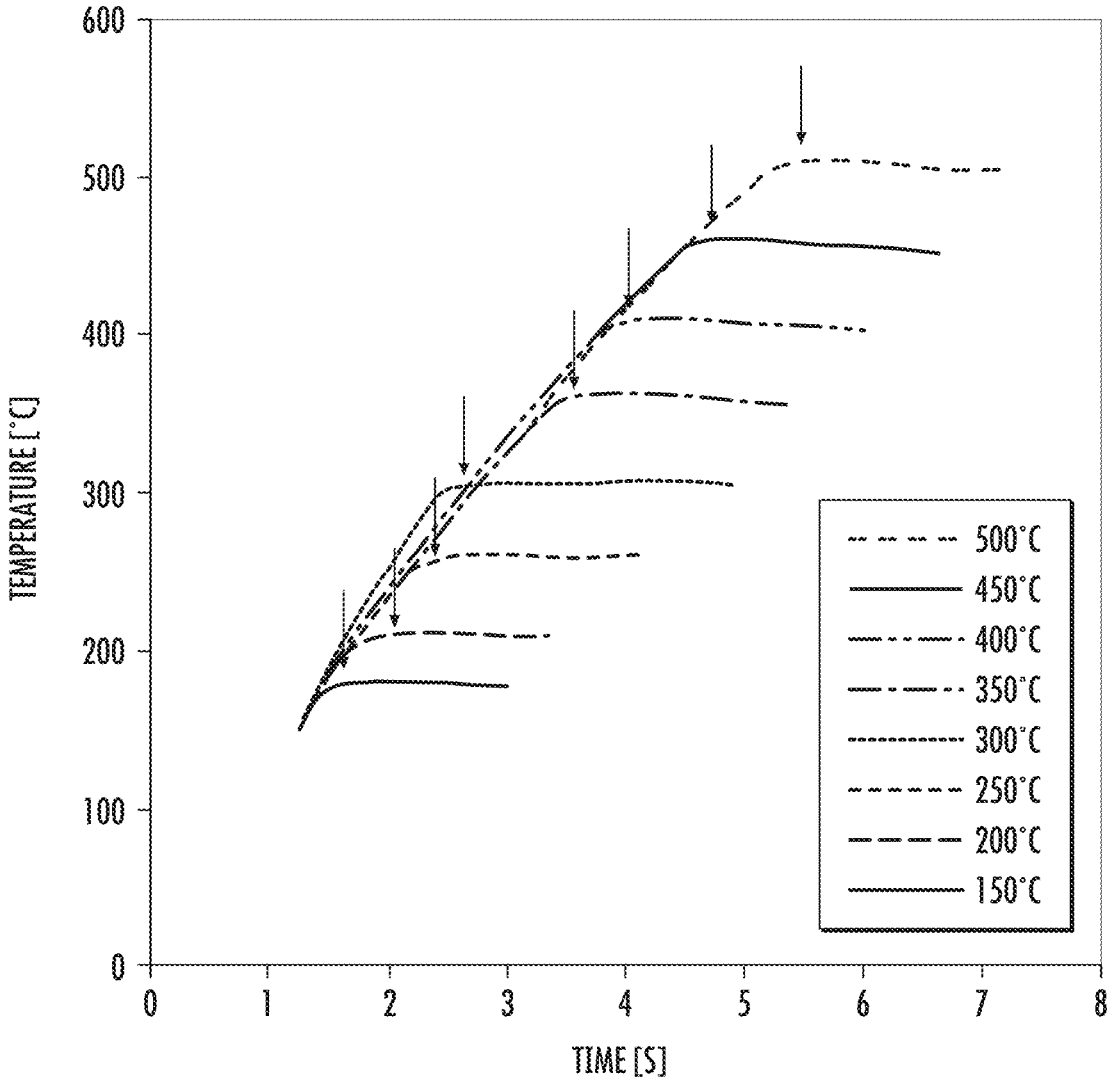
FIG. 2 is a line plot showing heating curves of AA6016 alloy samples heated to various temperatures (as indicated) by induction heating at a rate of 90° C./s. Arrows indicate the start of tensile testing.

Elevated temperature tensile testing of AA6016 alloy samples was performed. The testing samples were specimens of AA6016 alloy shaped as illustrated in FIG. 1. The specimens had a thickness of 1.2 mm. For elevated temperature testing, the specimens were heated to various temperatures by induction heating at a heating rate of 90° C./s. A pyrometer was used to measure the temperature of each specimen. The specified testing temperature of each specimen was maintained during the tensile testing. FIG. 2 shows heating curves of AA6016 samples before and during the tensile testing, with arrows indicating the start of tensile testing once the specimens achieved the target temperature. An AA6016 specimen and a steel specimen (DX56D (low carbon steel) from Voestalpine (Linz, Austria)) were also tested at room temperature. The steel sample tested at room temperature is referred to as "steel cold" in FIG. 3, while the AA6016 specimen tested at room temperature is referred to as "RT" in FIG. 3.

Figure 3:
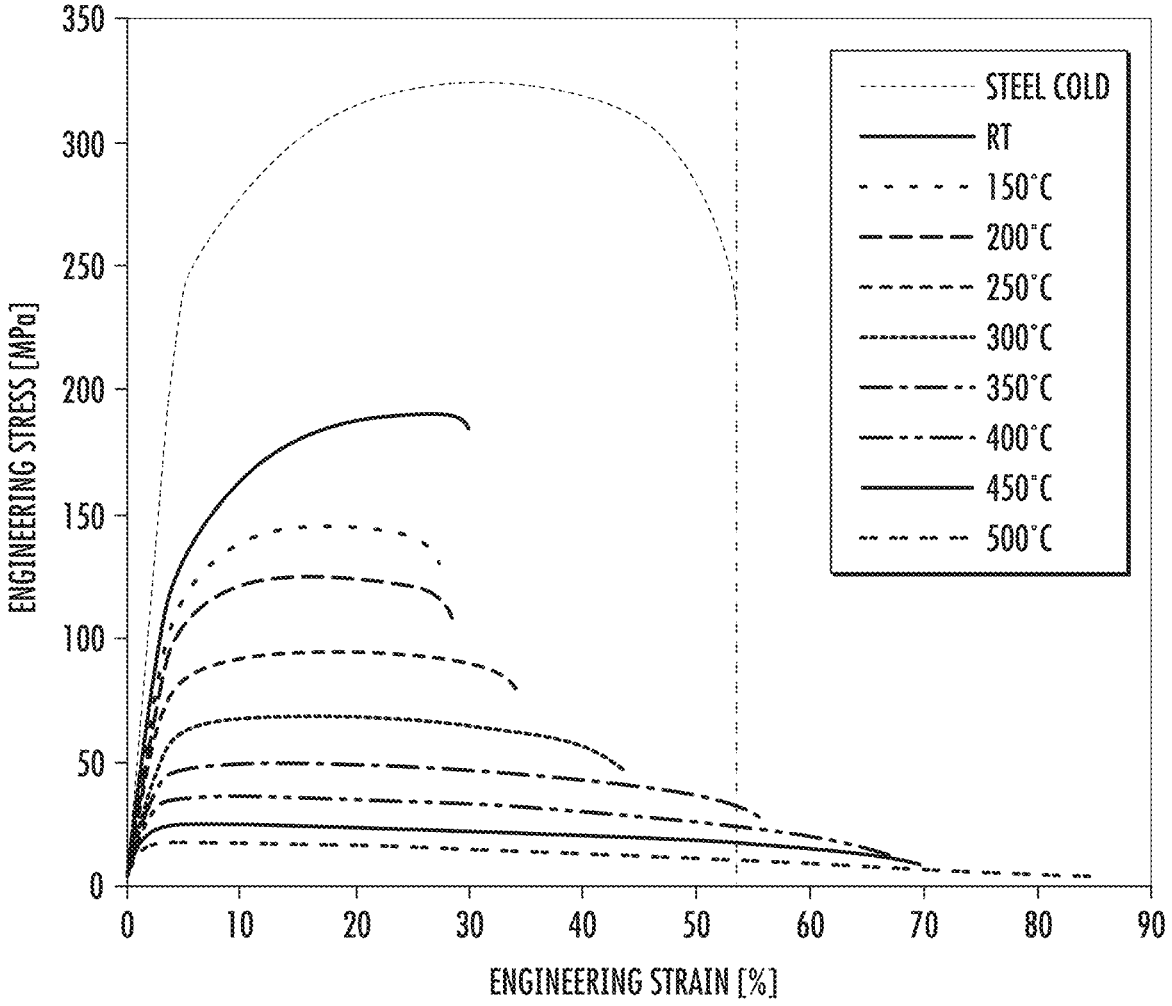
FIG. 3 is a line plot showing stress-strain curves of AA6016 alloy samples heated to various temperatures (as indicated) by induction heating at 90° C./s. Stress-strain curves of AA6016 and steel samples at room temperature ("RT" and "steel cold," respectively) are also shown. The steel sample is DX56D, a low carbon steel from Voestalpine (Linz, Austria). The vertical dotted line represents total elongation of the room temperature steel sample.

FIG. 3 shows stress-strain curves of the tested AA6016 samples and of the steel sample. The vertical dotted line represents total elongation of the steel sample. Tensile testing showed that heating AA6016 samples to a temperature of 250° C. or higher resulted in increased total elongation, in comparison to the total elongation exhibited by the AA6016 sample at room temperature. Heating AA6016 samples to 300° C. resulted in about 15% gain in total elongation. Surprisingly, AA6016 samples heated to 350° C. exhibited about the same total elongation as the room temperature steel sample. These results indicate that aluminum samples treated with the methods of the present invention may replace steel in some applications. Temperatures greater than 350° C. produced greater elongation than the steel samples, although thinning can increase at some of these higher temperatures. The engineering stress levels measured during the testing indicated that, as temperature increases, increasingly smaller forces would need to be applied during warm forming of AA6016 alloy.

Example 2

Post Heat Treatment Tensile Testing

Figure 4:
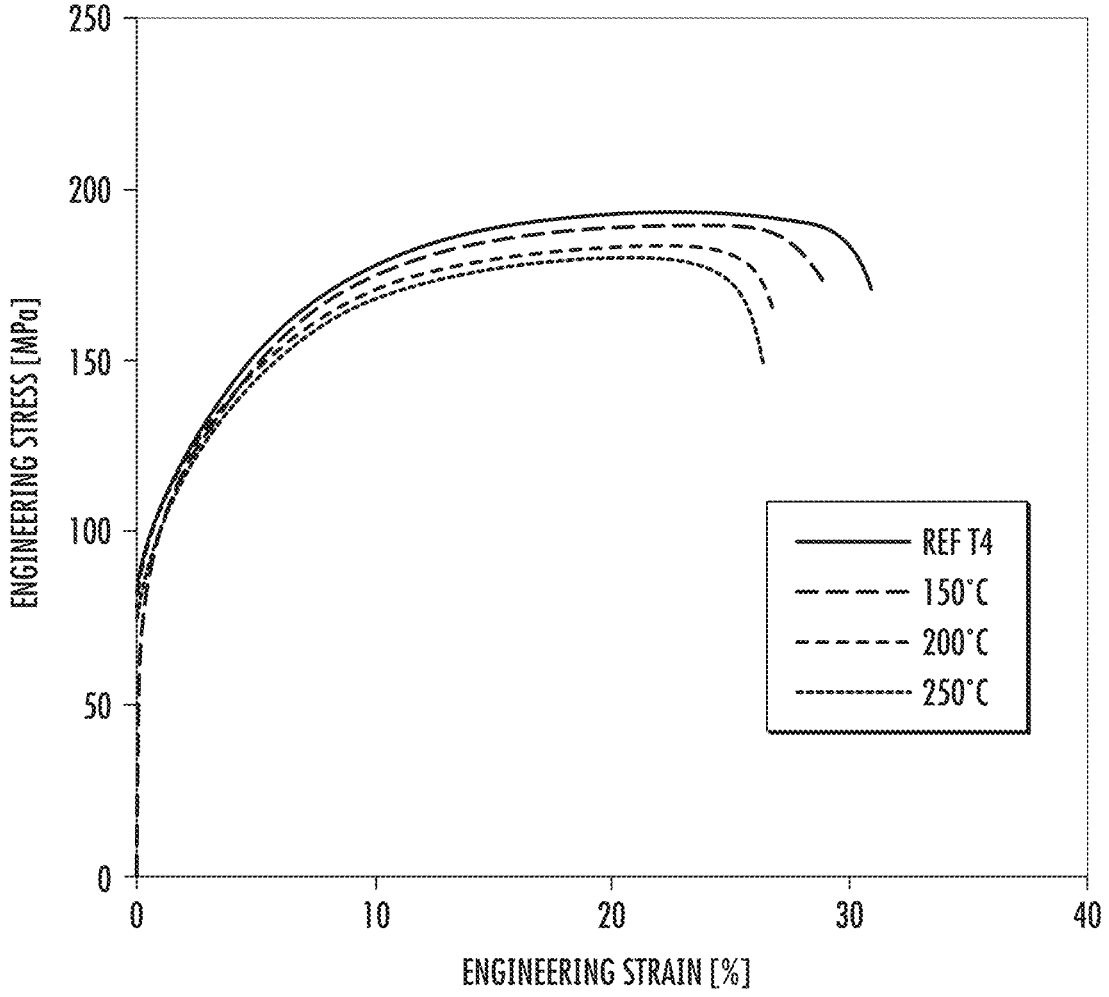
FIG. 4 is a line plot showing stress-strain curves of AA6016 alloy samples heated to various temperatures (as indicated) by induction heating at 90° C./s, water quenched, and aged for 1 week at room temperature. The stress-strain curve of the AA6016 alloy sample maintained at room temperature is also shown ("REF T4").

Post heat treatment tensile testing of AA6016 alloy samples was performed. Testing samples were the specimens of AA6016 alloy shaped as illustrated in FIG. 1. The specimens had a thickness of 1.2 mm. For post heat treatment testing, the specimens were heated to various temperatures by induction heating at a heating rate of 90° C./s, cooled in water ("water quenched"), and, subsequent to quenching, aged for 1 week at room temperature. A specimen of AA6016 maintained at room temperature ("room temperature specimen") was also tested for comparison. FIG. 4 shows stress-strain curves of post heat treatment AA6016 specimens. Post-heat treatment stress-strain curves shown in FIG. 4 are of substantially similar shape and magnitude, and are also similar to the stress-strain curve of the room temperature specimen (ref T4). The stress-strain curves shown in FIG. 4 demonstrate that the heat treatment used in the experiment did not alter the mechanical properties or metallurgical state of the AA6016 specimen.

Figure 5:
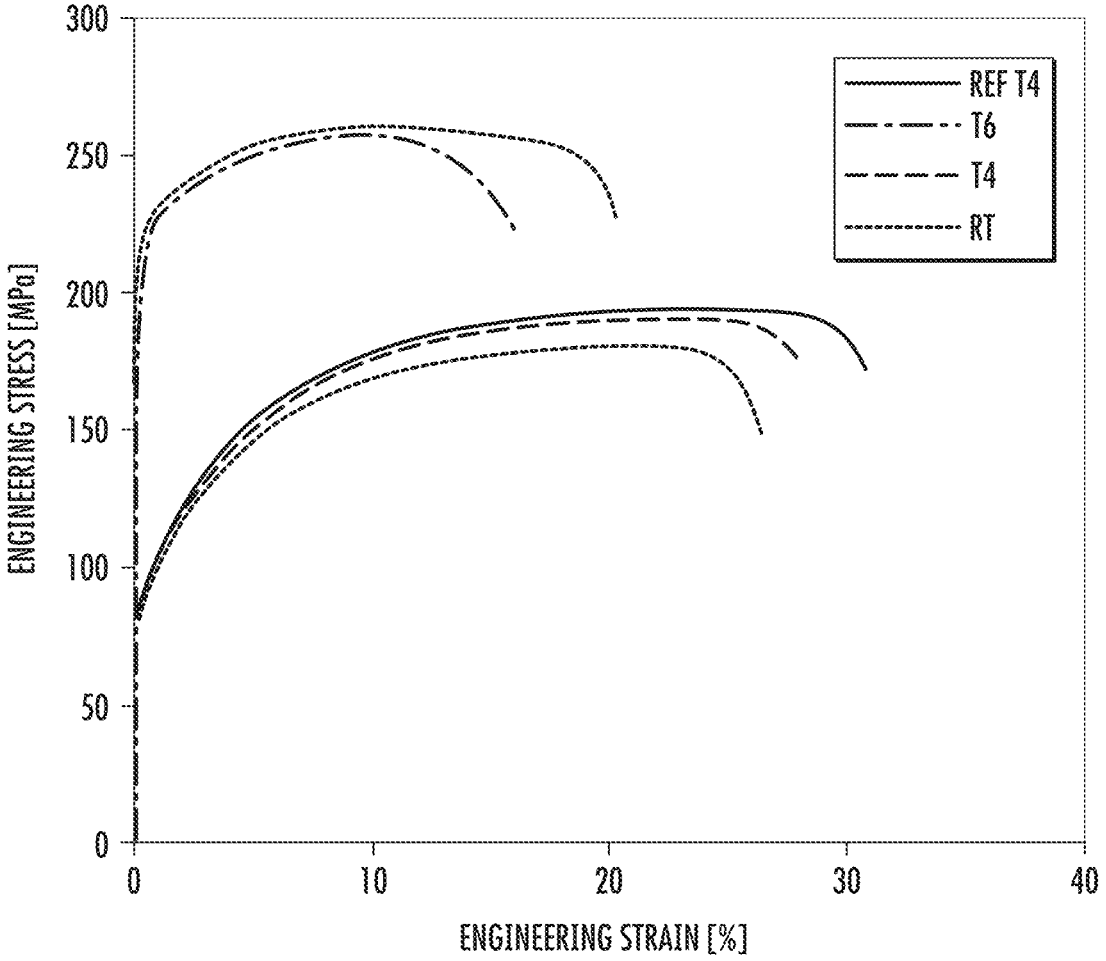
FIG. 5 is a line plot showing a representative stress-strain curve of FIG. 4 (lower set of curves; "T4") and, for comparison, a representative stress-strain curve (upper set of curves; "T6") of AA6016 alloy samples heated to various temperatures by induction at a rate of 90° C./s, water quenched, aged for 1 week at room temperature, heat-treated at 180° C. for 10 hours, then cooled to room temperature. The various warm forming temperatures represented in the exemplary curve shown include 150° C., 200° C., 250° C., 300° C., 350° C., 400° C., 450° C. and 500° C. In the upper set of curves, the stress-strain curve of an AA6016 sample that has not been subjected to warm forming is shown as the uppermost dotted line.
Figure 6:
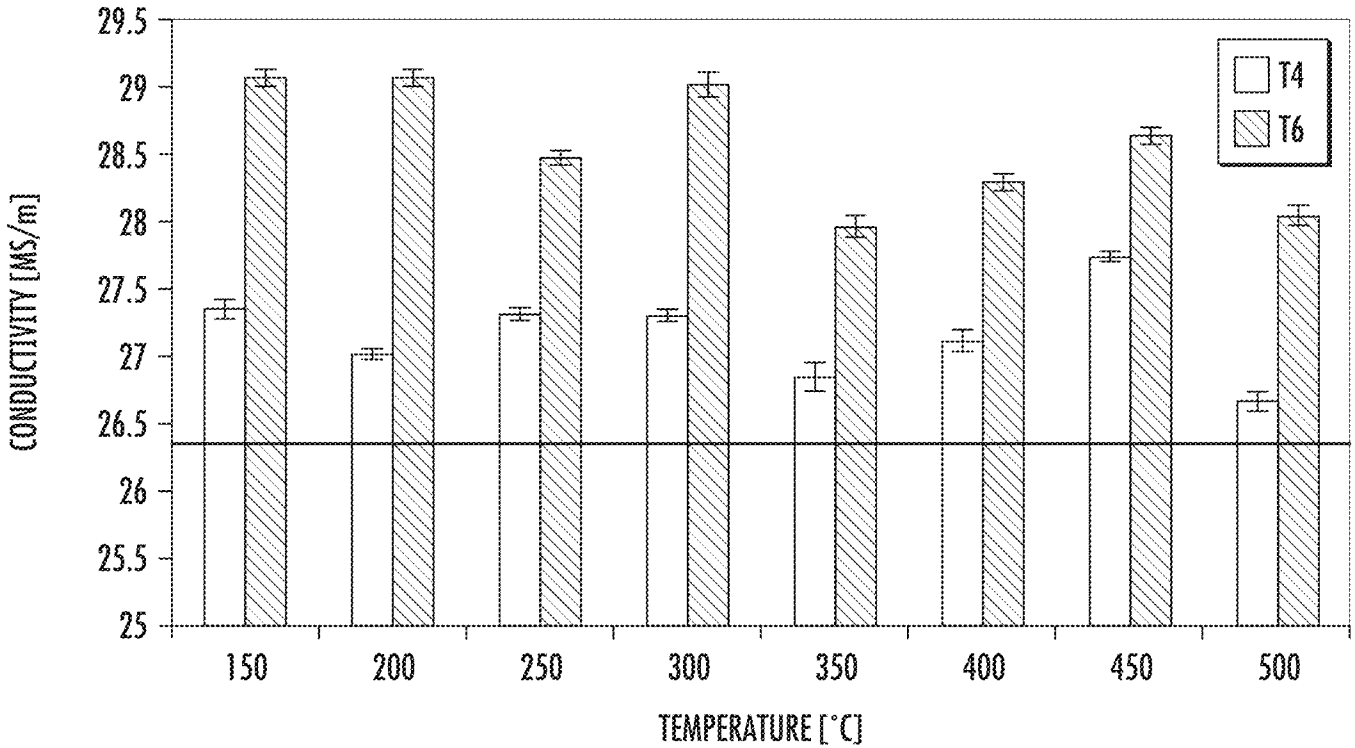
FIG. 6 is a bar graph showing the results of comparative electrical conductivity measurements of AA6016 alloy samples. Prior to a conductivity measurement, "T4" samples (left histogram bar of each pair) were heated to various temperatures by induction heating at a rate of 90° C./s, water quenched, and subsequently aged for 1 week at room temperature. "T6" samples (right histogram bar of each pair) were heated to various temperatures by induction heating at a rate of 90° C./s, water quenched, aged for 1 week at room temperature, heat-treated at 180° C. for 10 hours, then cooled to room temperature. The horizontal line indicates the conductivity level expected from AA6016 samples in T4 temper.

FIG. 5 shows stress-strain curves related to FIG. 4 (lower set of curves; REF T4, a room temperature formed sample RT, and a representative stress-strain curve for the exemplary sample, T4) and, for comparison, stress-strain curves of AA6016 alloy samples heated to various temperatures by induction heating at 90° C./s heating rate, water quenched, naturally aged for 1 week at room temperature, heat-treated at 180° C. for 10 hours, then cooled to room temperature (upper set of curves; alloy AA6016 not subjected to warm forming (uppermost dotted line) and a representative stress-strain curve for the exemplary sample, T6). FIG. 6 is a bar graph showing the results of comparative electrical conductivity measurements of AA6016 alloy samples treated in the same manner as for the tensile testing experiments used to generate FIG. 5. The horizontal line indicates the minimum conductivity value demonstrated by AA6xxx alloys in T4 temper. AA6016 alloy samples were heated to various temperatures by induction heating at 90° C./s, water quenched, and naturally aged for 1 week at room temperature, resulting in T4 temper. The conductivities of the T4 samples were measured and are illustrated as the left histogram in each set. Next the samples were heat-treated at 180° C. for 10 hours, then cooled to room temperature, resulting in T6 temper. Upon cooling, conductivities of the now T6 samples were measured, and are illustrated as the right histogram in each set. Based on the conductivity data, all the AA6016 samples remained in T4 temper post heat treatment when maintained at room temperature for 1 week. In comparison, AA6016 samples subsequently heat-treated at 180° C. for 10 hours exhibited age-related hardening and transition into T6 temper. The above data indicated that it was possible to maintain T4 temper and avoid age hardening of AA6016 aluminum alloy for a period of time after warm forming. This phenomenon pointed to lasting formability of warm formed aluminum alloy sheet, which may permit performance of additional stamping steps after warm forming. The above data also indicated that heat treated AA6016 alloy samples preserved their age hardening potential and therefore may be age hardened subsequent to warm forming (for example, by heat treatment during paint baking or post forming heat treatment).

Example 3

Figure 7:
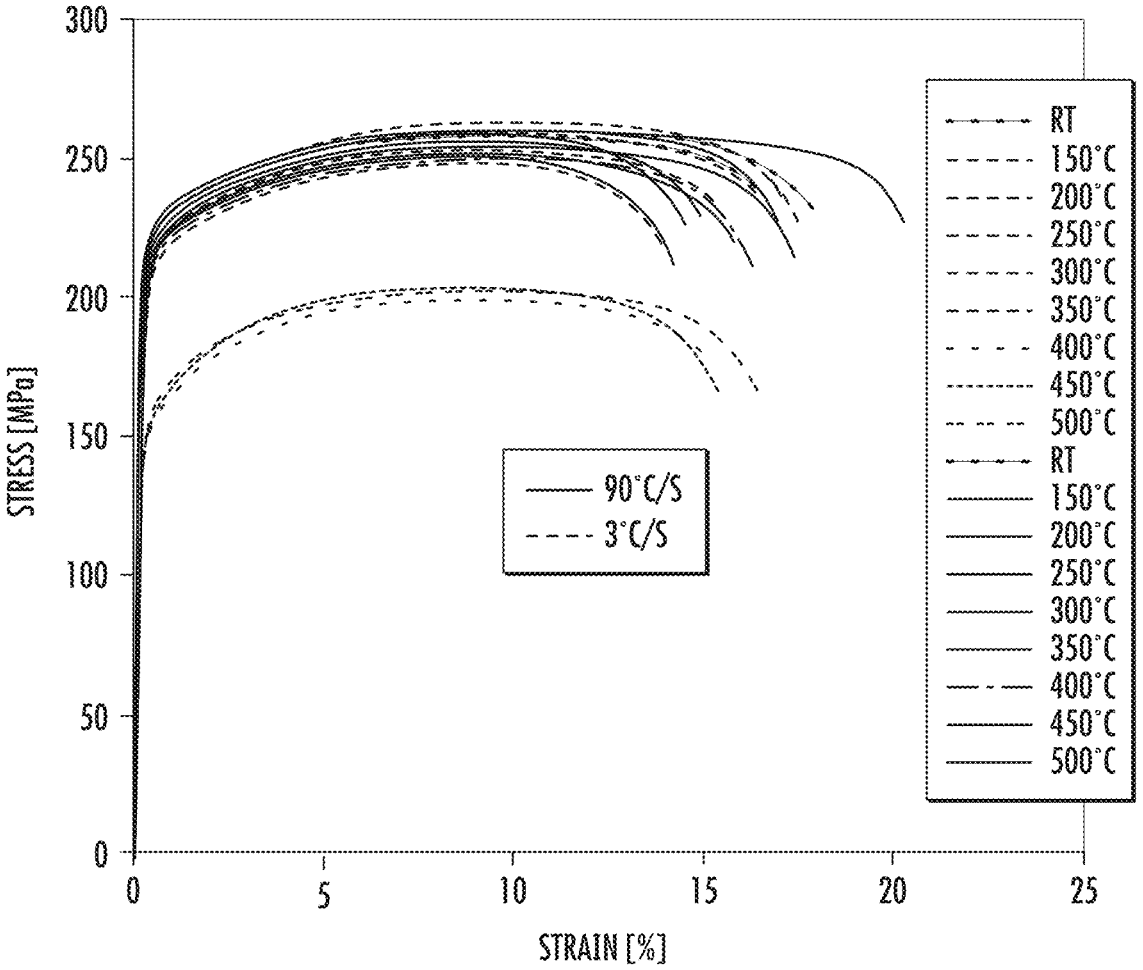
FIG. 7 is a line plot showing stress-strain curves of the AA6016 alloy samples of FIG. 4 heated to various temperatures (as indicated) by induction heating at rates of 90° C./s (upper set of curves) and 3° C./s (lower set of curves), water quenched, aged for 1 week at room temperature, heat-treated at 180° C. for 10 hours, then cooled to room temperature. The stress-strain curves of AA6016 alloy samples maintained at room temperature are also shown ("RT").
Figure 8:
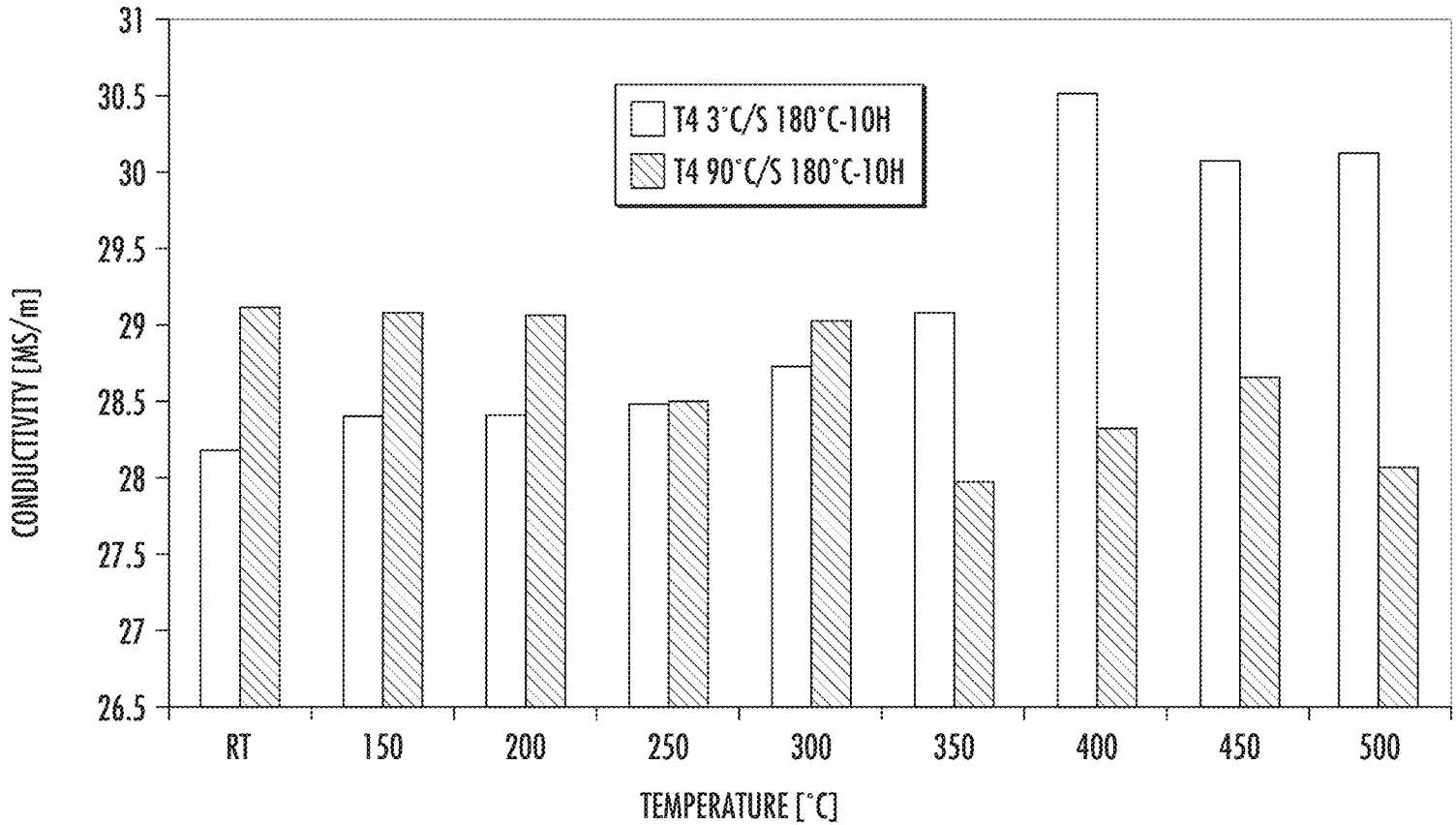
FIG. 8 is a bar graph showing the results of comparative electrical conductivity measurements of AA6016 alloy samples heated to various temperatures (as indicated) by induction heating at rates of 90° C./s (right histogram bar of each pair) and 3° C./s (left histogram bar of each pair), water quenched, aged for 1 week at room temperature, heat-treated at 180° C. for 10 hours, then cooled to room temperature. The left 3° C./s histogram bars (indicated in black) at 400° C., 450° C. and 500° C. indicate overaging.

Post Heat Treatment Tensile Testing of Samples Heated at Different Heating Rates Post heat treatment tensile testing of AA6016 alloy samples heated at different heating rates was performed. Testing samples were the specimens of AA6016 alloy illustrated in FIG. 1. The specimens had a thickness of 1.2 mm. For post heat treatment testing, the specimens were heated (referred to as "HT" in FIGS. 7-8) to various temperatures by induction heating at a 90° C./s heating rate (top set of curves in FIG. 7 and left histogram in each set in FIG. 8) or a 3° C./s heating rate (bottom set of curves in FIG. 7 and right histogram in each set in FIG. 8), cooled in water (i.e, "WQ" referring to water quenched), naturally aged for 1 week at room temperature, heat-treated at 180° C. for 10 hours, then cooled to room temperature. AA6016 maintained at room temperature was also tested for comparison and is referred to as "RT" in FIGS. 7-8. FIG. 7 shows stress-strain curves of the tested AA6016 specimens. FIG. 8 is a bar graph showing the results of comparative electrical conductivity measurements of AA6016 alloy samples treated in the same manner as the samples in the experiments used to generate FIG. 7.

The experimental data illustrated in FIGS. 7 and 8 demonstrated that overaging of AA6016 occurred, with the accompanying loss of strength, when the alloy was heated at 3° C./s heating rate to temperatures of 400° C. and above (see lower group of curves in FIG. 7 and the left histogram bars of the histogram bar pairs in FIG. 8 at 400° C., 450° C. and 500° C.). The conductivity measurements confirmed that AA6016 was overaged when heat treated under the above conditions, as indicated by conductivity values above 30 MS/m. The above data also indicated that care should be taken to select heating and warm forming parameters to avoid averaging. A higher heating rate (90° C./s) provided for a wider range of heating temperatures in which overaging did not occur.

Example 4

Thinning Testing

Figure 9:
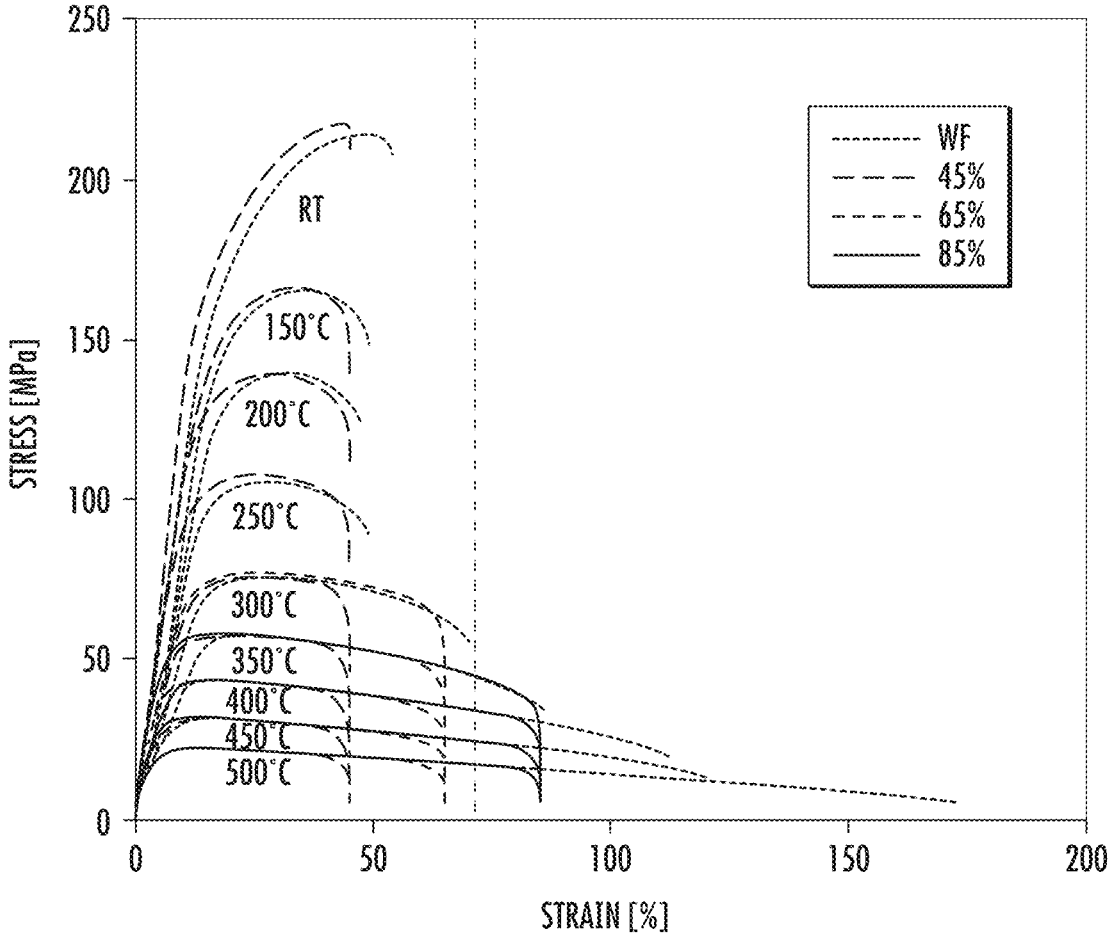
FIG. 9 is a line plot showing stress-strain curves of AA6016 alloy samples used in thinning testing. The samples were heated to various temperatures (as indicated) by induction heating at 90° C./s. Pre-strains of 45%, 65% and 85% were performed at the indicated temperatures.
Figure 10:
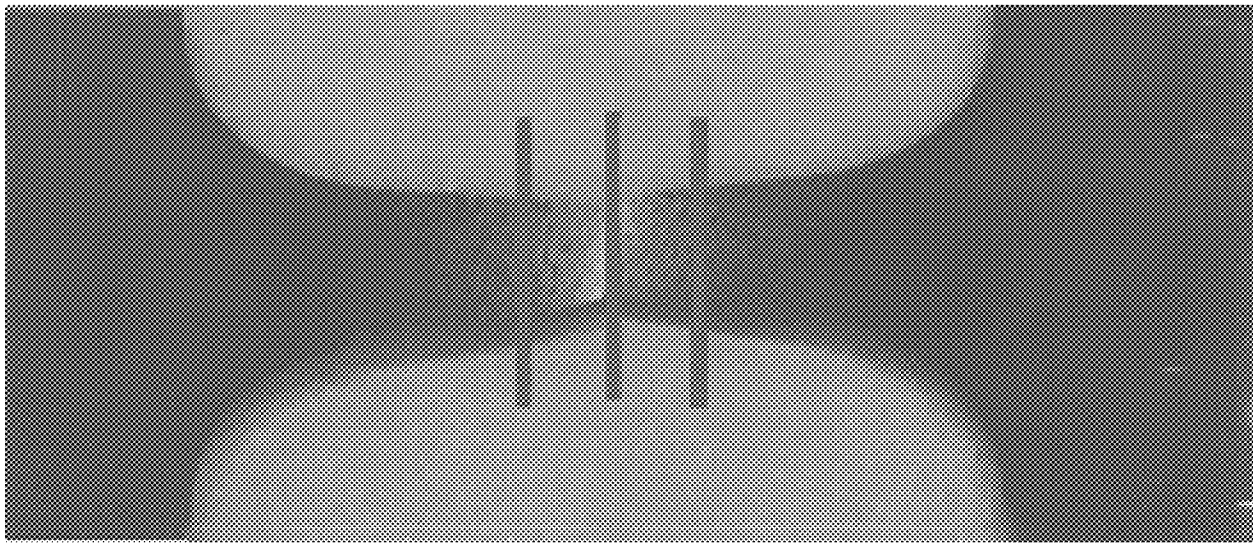
FIG. 10 is a photograph of a side view of an exemplary aluminum alloy specimen used for the thinning measurements. The horizontal lines illustrate the positions of the thinning measurements.

Tensile pre-straining of AA6016 alloy samples and their thinning measurements were performed. Testing samples were the specimens of AA6016 alloy shaped as illustrated in FIG. 1. The specimens had a thickness of 1.2 mm. The specimens were pre-strained to 45%, 65% and 85% at each indicated temperature by induction heating at 90° C./s. AA6016 specimens were also tested at a room temperature (referred to as "RT" in FIG. 9). Thinning of each sample was measured after pre-straining at room temperature at the locations illustrated in FIG. 10, which is a photograph of the longitudinal side view of an exemplary aluminum alloy specimen used for the thinning measurements. The horizontal lines illustrate the positions where the thinning measurements were taken; the smallest thickness measurements was used to calculate the thinning value. For the thinning measurements, the specimens were warm-formed and pre-strained to 45%, 65% or 85% at each temperature, or warm-formed and not pre-strained (indicated as "WF" in FIG. 9) at each temperature. FIG. 9 shows stress-strain curves of AA6016 specimens during the tensile testing at temperatures up to failure, with the stress-strain curves measured during the pre-straining steps at the stated temperatures. The vertical dotted line represents the total elongation of the previously measured steel sample. The testing showed how far from failure the samples are with pre-straining.

Figure 11:
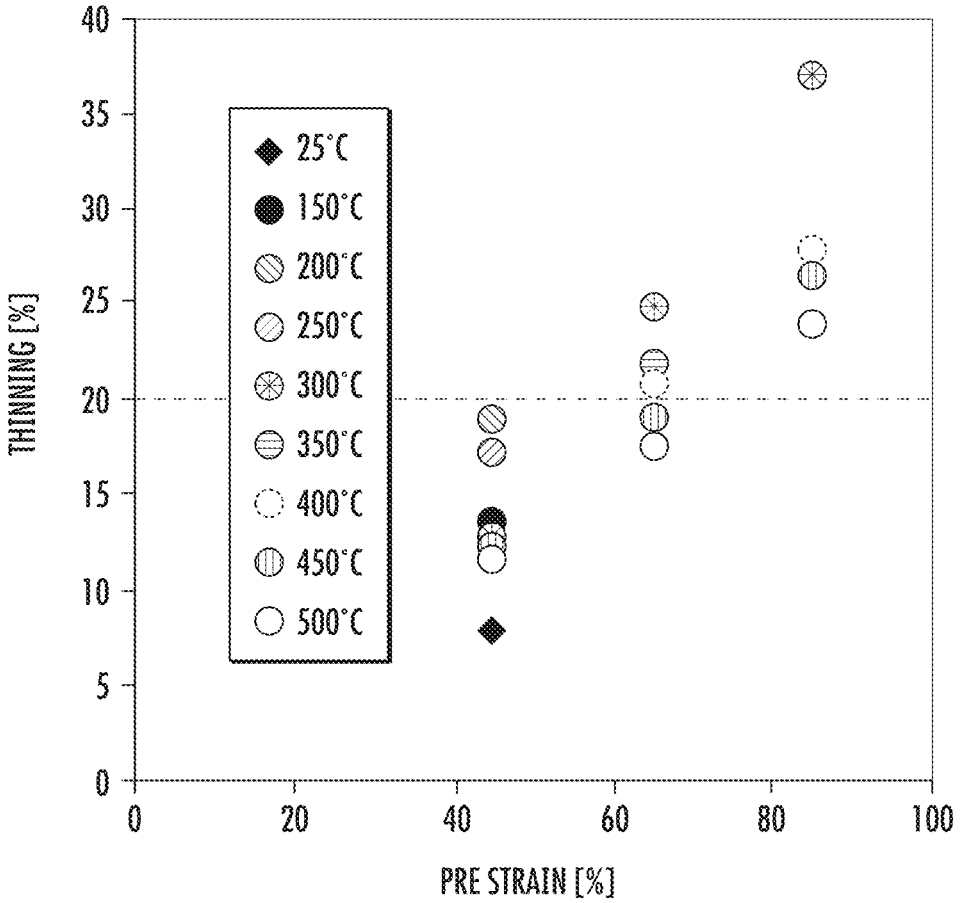
FIG. 11 is a dot plot illustrating a "thinning map" of pre-strained AA6120 alloy samples (stress-strain curves shown in FIG. 7) heated to various temperatures (as indicated) by induction heating at a heating rate of 90° C./s. The typical desired thinning range depends on the final application and varies between 15% and 20%.
Figure 12:
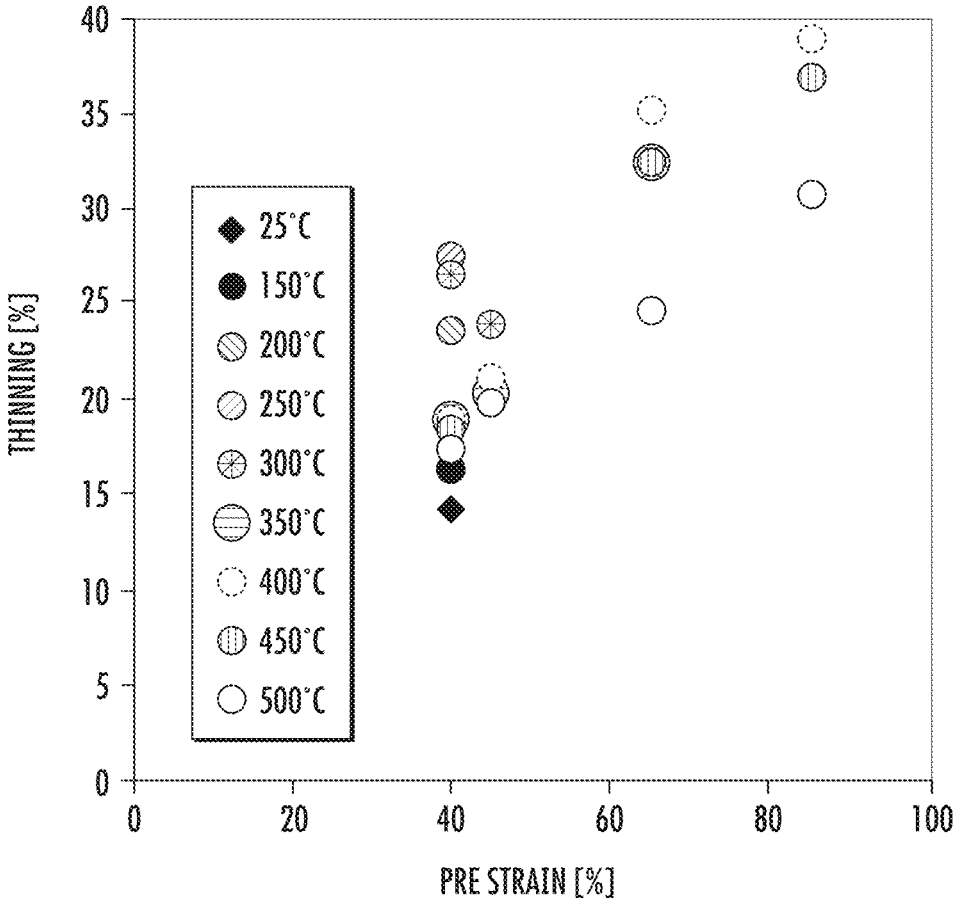
FIG. 12 is a dot plot illustrating a "thinning map" of pre-strained AA6111 alloy samples (stress-strain curves shown in FIG. 7) heated to various temperatures (as indicated) by induction heating at a heating rate of 90° C./s. The typical desired thinning range depends on the final application and varies between 15% and 20%.
Figure 13:
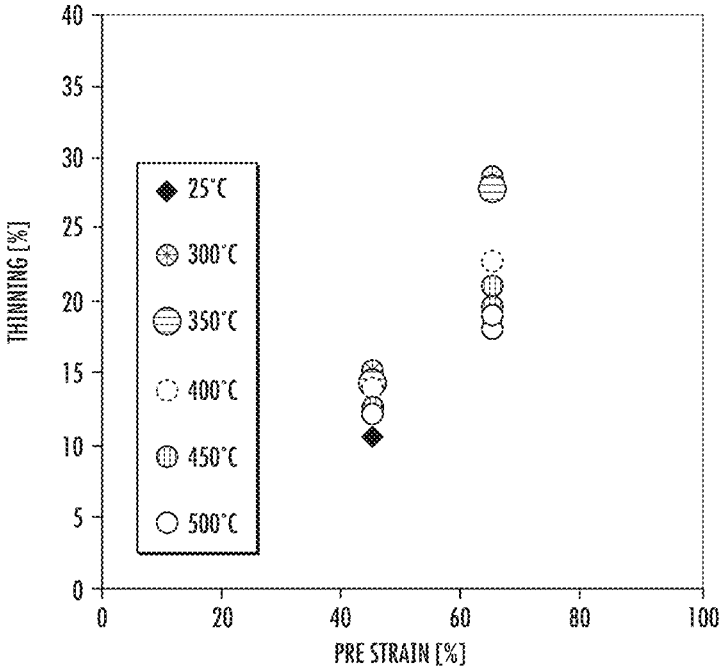
FIG. 13 is a dot plot illustrating a "thinning map" of pre-strained AA6170 alloy samples (stress-strain curves shown in FIG. 7) heated to various temperatures (as indicated) by induction heating at a heating rate of 90° C./s. The typical desired thinning range depends on the final application and varies between 15% and 20%.

FIGS. 11, 12 and 13 show a "thinning map" of the specimens at various pre-strain and temperature values. The data used in FIGS. 11, 12 and 13 demonstrates that a temperature range exists between 150° C. and 450° C., for example, 250-350° C., in which the tested alloys simultaneously exhibited a gain in total elongation of up to 30%, for example, 5-15% and limited thinning (for example, about 20% or less). A comparison of thinning maps for different alloys (AA6120 (FIG. 11), AA6111 (FIG. 12) and AA6170 (FIG. 13) also demonstrated that the thinning phenomenon can be modulated by adjusting alloy compositions.

Example 5

Laboratory Scale Stamping

Aluminum alloy AA6170 sheets (1 mm thickness) were cut to 270 cm×270 cm blanks and stamping was performed. The square pieces were optionally heated according to methods described herein. Four samples were used for the stamping experiment. Samples 1 and 2 were not heated and stamped at ambient temperature (about 25° C.). Sample 3 was heated to a stamping temperature of 200° C. Sample 4 was heated to a stamping temperature of 350° C. Test parameters and results are presented in Table 1.

TABLE 1

| Sample No. | Preheat Temperature ° C. | Draw Depth mm | Result |
|---|---|---|---|
| 1 | N/A | 40 | Did not fail |
| 2 | N/A | 43 | Failure |
| 3 | 200 | 40 | Failure |
| 4 | 350 | 70 | Did not fail |

Figure 14:
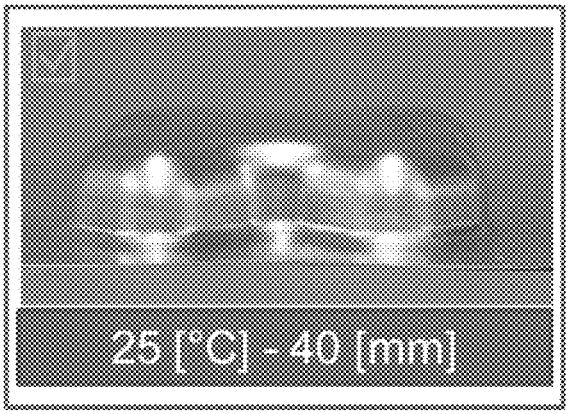
FIG. 14 is a photograph of a stamped AA6170 alloy used for testing that was not subject to preheating.
Figure 15:
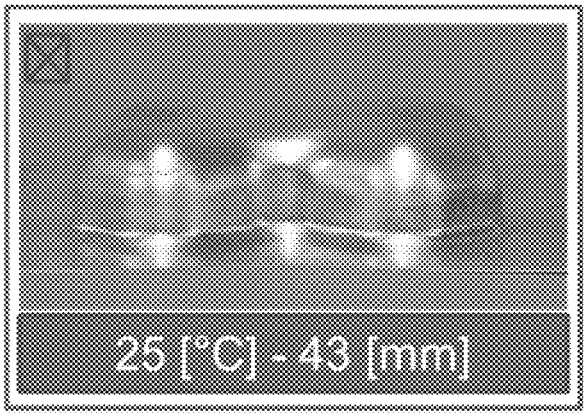
FIG. 15 is a photograph of a stamped AA6170 alloy used for testing that was not subject to preheating.

Sample 1 was drawn to a depth of 40 mm and did not exhibit cracking indicating material failure as shown in FIG. 14. Sample 2 was drawn to a depth of 43 mm and cracking is evident as shown in FIG. 15. These results suggest 40 mm is the maximum draw depth achievable when stamping pieces at room temperature.

Figure 16:
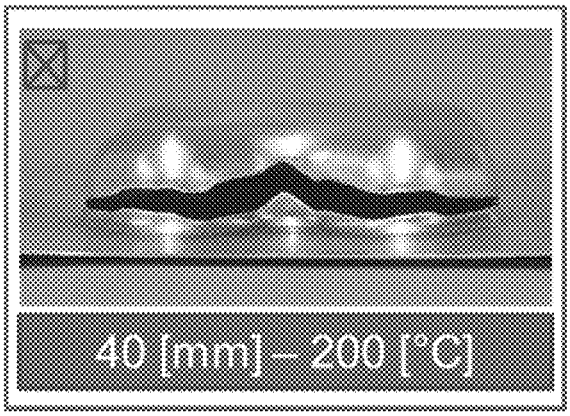
FIG. 16 is a photograph of a stamped AA6170 alloy used for testing that was preheated to 200° C. before stamping.
Figure 17:
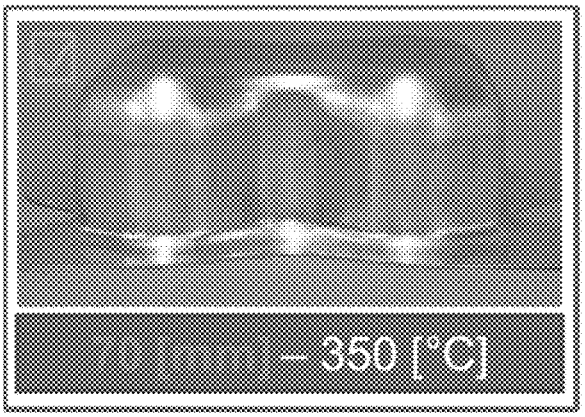
FIG. 17 is a photograph of a stamped AA6170 used for testing that was alloy preheated to 350° C. before stamping.

When preheated to 200° C., Sample 3 cracked and exhibited failure at a draw depth of 40 mm, as shown in FIG. 16. When preheated to 350° C., Sample 4 did not exhibit cracking at a draw depth of 70 mm, as shown in FIG. 17, suggesting that stamping a draw depth of 75 mm is achievable without failure when preheated to 350° C.

Figure 18:
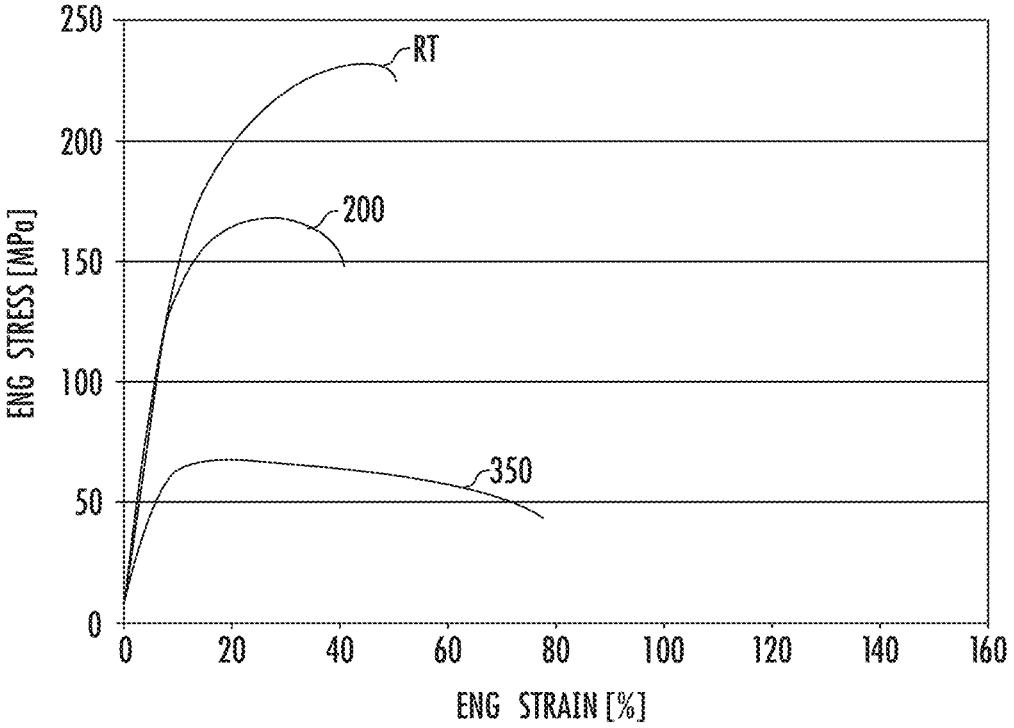
FIG. 18 is a line plot showing stress-strain curves of an AA6170 alloy used in stamping experiments described in Example 5 (at preheating temperatures of room temperature, 200° C., 350° C.).

The stamping results described in Example 5 and shown in FIGS. 14-17 are consistent with the elongation measured from the tensile curves presented in FIG. 18. For example, the tensile curve for Sample 4 (350° C.) shows a higher engineering strain value (x-axis) as compared to the tensile curves for both Sample 1 and Sample 2 (room temperature, referred to as "RT" in FIG. 18) and Sample 3 (200° C.), which have a lower engineering strain value. The engineering strain values for both room temperature and 200° C. tensile curves are similar, which is consistent with the experimental results of observing cracking in Sample 2 at a depth of 43 mm and cracking in Sample 3 at a depth of 40 mm. The formability of the sheets can be characterized by the achievable draw depth without cracking of the stamped part. A greater draw depth can indicate greater formability.

All patents, patent applications, publications, and abstracts cited above are incorporated herein by reference in their entirety. Various examples of the invention have been described in fulfillment of the various objectives of the invention. These examples are merely illustrative of the principles of the present invention. Numerous modifications and adaptations thereof will be readily apparent to those of skill in the art without departing from the spirit and scope of the invention as defined in the following claims.

What is claimed is:

1. A process of shaping an article made of an age-hardenable, heat treatable aluminum alloy, comprising:

producing an article comprising:

casting an aluminum alloy into an ingot, wherein the aluminum alloy comprises 0.40-1.5 wt. % Si, 0.30-1.5 wt. %, Mg, 0-1.5 wt. % Cu, 0-0.40 wt. % Mn, 0-0.30 wt. % Cr, 0-0.15 wt. % impurities, and Al;

hot rolling the ingot to produce an article;

solution heat treating the article to a T4 temper; and forming the article, wherein forming comprises:

heating the article to a shaping temperature of 350° C. to 500° C. at a heating rate of 3° C./second to 90° C./second; and, shaping the article at the shaping temperature, wherein the shaping comprises cutting, stamping, pressing, press-forming, or drawing the article at the temperature of 350° C. to 500° C.;

wherein the article has a thinning value of less than 22% after shaping; and wherein the article is in T4 temper after forming the article.

2. The process of claim 1, wherein the article is a sheet.

3. The process of claim 1, further comprising cooling the shaped article.

4. The process of claim 3, further comprising a second shaping step after the cooling step.

5. The process of claim 1, wherein the engineering strain of the heated article is 40-90%.

6. The process of claim 1, wherein elongation of the heated article is increased by up to 30% in comparison to the article prior to the heating step.

7. The process of claim 1, wherein shaping the article comprises stamping, pressing, or press-forming.

8. The process of claim 1, wherein the heating the article comprises induction heating.

9. The process of claim 1, wherein the process produces a motor vehicle panel.

* * * * *